US007475578B2

(12) United States Patent
Brown et al.

(10) Patent No.: US 7,475,578 B2
(45) Date of Patent: Jan. 13, 2009

(54) DOOR LOCKING SYSTEM CONVERSION ADAPTER

(75) Inventors: Gerald L. Brown, Logan, UT (US); Timothy V. George, Smithfield, UT (US)

(73) Assignee: Nobilus, LLC, Korrine, UT (US)

( * ) Notice: Subject to any disclaimer, the term of this patent is extended or adjusted under 35 U.S.C. 154(b) by 156 days.

(21) Appl. No.: 11/093,917

(22) Filed: Mar. 29, 2005

(65) Prior Publication Data

US 2005/0229656 A1 Oct. 20, 2005

Related U.S. Application Data

(60) Provisional application No. 60/558,233, filed on Mar. 30, 2004.

(51) Int. Cl.
*E05B 9/08* (2006.01)

(52) U.S. Cl. ..... 70/451; 70/370; 70/448; 70/461; 70/466; 292/336.3; 292/DIG. 54

(58) Field of Classification Search ..... 70/107, 70/370–374, 448–450, 461, 466; 292/336.3, 292/336.5, 347, DIG. 54
See application file for complete search history.

(56) References Cited

U.S. PATENT DOCUMENTS 1,846,364 A * 2/1932 Schlage ..... 70/354
2,921,461 A * 1/1960 Schlage ..... 70/451
3,293,892 A * 12/1966 Falk ..... 70/493
4,576,023 A * 3/1986 Crepinsek ..... 70/137
5,474,348 A * 12/1995 Palmer et al. ..... 292/359
5,893,282 A * 4/1999 Runge et al. ..... 70/208
5,992,195 A * 11/1999 Huang et al. ..... 70/472
6,606,890 B1 * 8/2003 Widen ..... 70/369
2005/0011239 A1 * 1/2005 Lurie et al. ..... 70/369

FOREIGN PATENT DOCUMENTS

EP 442384 A2 * 8/1991

* cited by examiner

*Primary Examiner*—Patricia Engle
*Assistant Examiner*—Christopher Boswell
(74) *Attorney, Agent, or Firm*—Reinhart Boerner Van Seuren s.c.

(57) ABSTRACT

The present invention features a system and method for operating or operably connecting an American locking cylinder with a Profile mortise lock, wherein the American locking cylinder functions with the Profile mortise lock in place of a Profile locking cylinder. Essentially, the present invention provides a door lock cylinder conversion adapter that converts an American cylinder to be operable with a Profile mortise lock. The door lock cylinder conversion adapter functions to actuate the internal locking mechanism of a Profile mortise lock much the same way a standard Profile locking cylinder would, only with an American locking cylinder providing the means for effectuating the actuation.

19 Claims, 7 Drawing Sheets

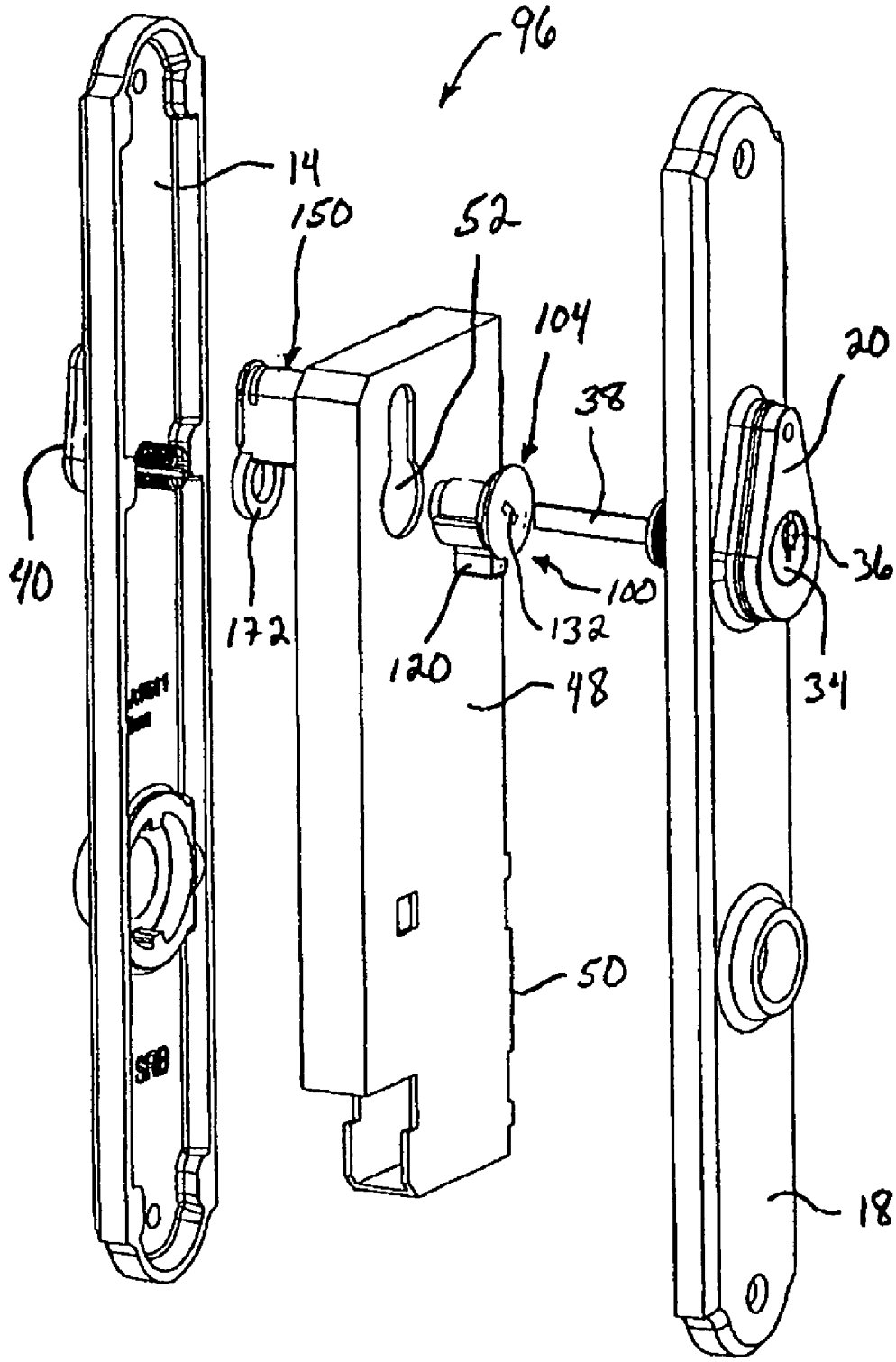
FIGURE 3-A

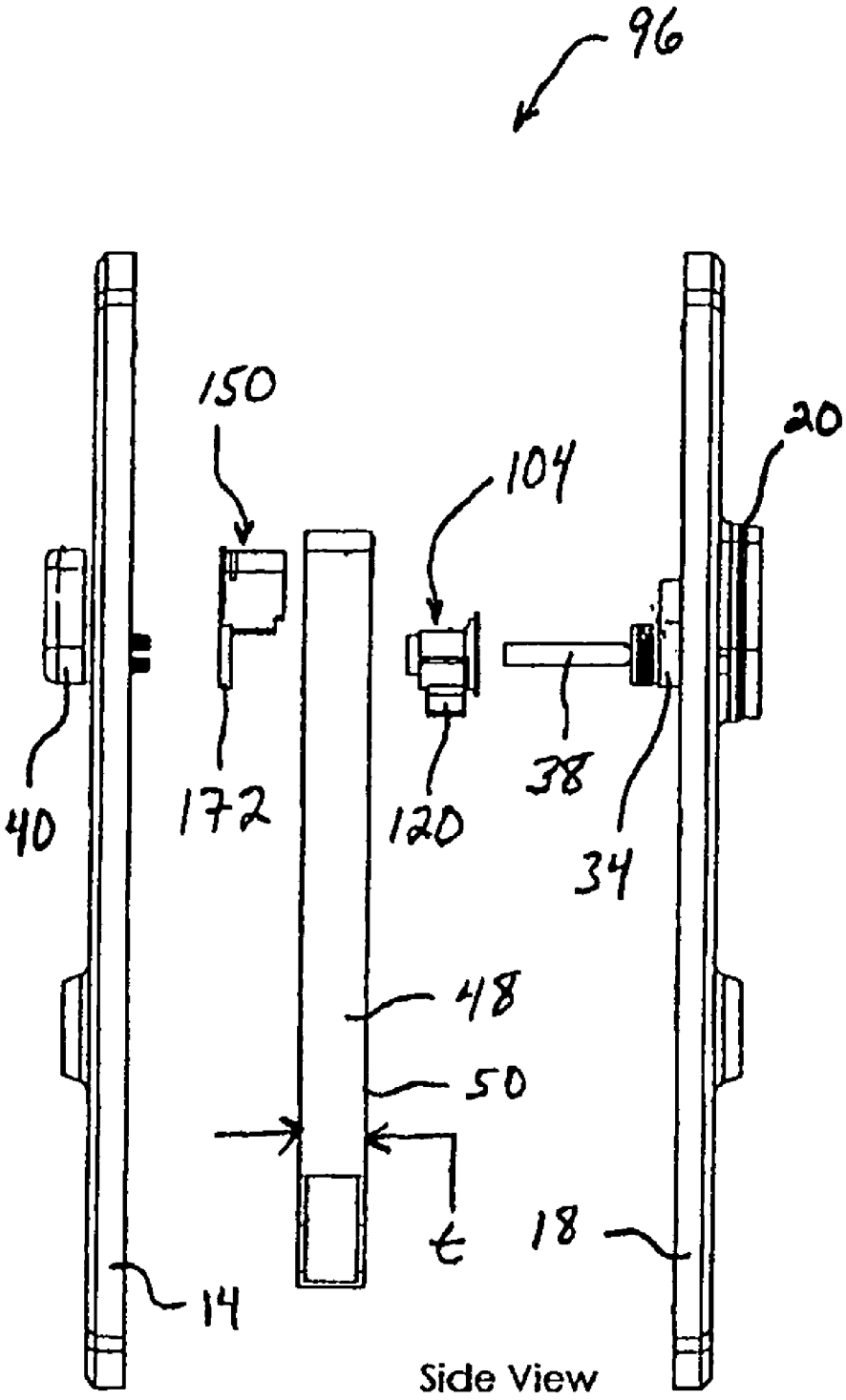
FIGURE 3-B

SECTION B-B
SCALE 4 : 1

DOOR LOCKING SYSTEM CONVERSION ADAPTER

CROSS-REFERENCE TO RELATED APPLICATION AND CLAIM OF PRIORITY

Priority of U.S. Provisional patent application Ser. No. 60/558,233 filed on Mar. 30, 2004 is claimed.

FIELD OF THE INVENTION

This invention relates to door locking systems, and particularly to a conversion adapter configured for use with a door locking system.

BACKGROUND OF THE INVENTION AND RELATED ART

In the current window and door market there are two primary or main locking cylinders used to secure windows and doors in a secured or locked position. The first is the American cylinder and the second is the Profile cylinder.

As shown in FIG. 1, a prior art door locking system 10 is shown having an internal plate mount 14 and an external plate mount 18 positioned on either side of an American cylinder mortise lock 22. The American cylinder mortise lock 22 comprises a mortise receiver 24 and various internal locking components, including a bolt 26. The American cylinder mortise lock 22 is operable with an American cylinder lock 34 having an internal cam (not shown) used to selectively turn the components of mortise lock 22, and particularly bolt 26, thus locking and unlocking a door (not shown). The internal cam further prevents American cylinder 34 from freely rotating. Instead, the cam is made to contact one or more stoppers within American cylinder 34 that limit its range of rotation.

The American cylinder lock 34 is widely used in the United States as a standard cylinder lock. It is small and mounts from behind the door hardware. A flat tailpiece 38 extends from behind the mechanism of American cylinder lock 34 and extends into mortise receiver 24. When a key is inserted and turned, the internal cam causes tailpiece 38 to rotate, which subsequently turns or drives bolt 26 inside mortise lock 24. Turning the cam functions to drive bolt 26 into a door jamb (not shown), thus locking the door. The benefit of the American cylinder is that it is cost effective. In addition, because the American cylinder lock is mounted from behind the door hardware, and particularly external plate mount 18, it is protected from environmental elements that can corrode or rust its various components. As such, the life of locking mechanism 10 is extended and the durability of the locking mechanism is increased. Another benefit is that tailpiece 38 can comprise different lengths that are easily interchangeable or cut to accommodate different door thicknesses.

Referring now to FIG. 2, shown is another prior art door locking system 10. Door locking system 10 comprises an internal plate mount 40 and an external plate mount 44 positioned on either side of a Profile cylinder mortise lock 48. A Profile cylinder mortise lock 48 comprises an eyehole 52 allowing access to various internal locking components, such as a bolt (not shown). Profile cylinder mortise lock 48 is operable with a Profile cylinder 54 having a cam 56 used to selectively turn the components of mortise lock 48, and particularly the bolt, thus locking and unlocking a door. A Profile cylinder 54 is a type of locking cylinder that is primarily used in Europe, but that is also frequently used in the United States. A Profile cylinder 54 mounts by placing it through external plate mount 40 and mortise lock 48 with a screw 50 coming in edgewise, thus securing Profile cylinder 54 into place. Unlike the American cylinder illustrated in FIG. 1, Profile cylinder 54 has no tailpiece. Instead, cam 56 is built directly into Profile cylinder 54. When a key is inserted and turned, cam 56 is caused to rotate. This rotation subsequently drives the bolt into the door jamb, thus securing or locking the door.

There are several deficiencies inherently associated with the Profile-type locking assembly. The Profile cylinder is comparatively expensive compared to the cost of the American cylinder. Thus, if the locking cylinder malfunctions or breaks, the purchase of a new one will be significant as compared to other locking cylinders. In addition, the Profile cylinder mounts from the outside of the door as shown in FIG. 2, thus leaving its component parts exposed to environmental elements that can corrode the various internal components. Another disadvantage is that there is no tailpiece. Because there is no tailpiece, in order to accommodate different door thicknesses, an entire new locking cylinder must be purchased. Thus, a particular Profile locking assembly made for one door thickness may not be interchanged for use on another door thickness. And, since different manufactures offer several different door thicknesses, several different sized Profile cylinders must be manufactured and stocked. Finally, the components of the Profile door locking assembly do not fit tightly together, but comprise varying degrees of slop. Other problems not specifically recited herein will be apparent to one skilled in the art.

SUMMARY OF THE INVENTION

The present invention includes a system and method for operating or operably connecting an American locking cylinder with a Profile cylinder mortise lock, wherein the American locking cylinder functions with the Profile cylinder mortise lock in place of a Profile locking cylinder. Essentially, the present invention provides a door cylinder conversion adapter that converts an American cylinder to be operable with a Profile cylinder mortise lock.

In a door locking system or door or door locking assembly, the present invention comprises: (a) a Profile mortise lock supported within a door between American-type internal and external plate mounts, wherein the Profile mortise lock has an eyehole configured to receive a Profile cylinder; (b) an American locking cylinder supported by the external plate mount, wherein the American locking cylinder comprises a tailpiece extending therefrom, as well as a turn piece mounted on the internal plate mount for receiving and seating an end portion of the tailpiece; and (c) a door lock cylinder conversion adapter for operably connecting said American locking cylinder with said Profile cylinder mortise lock, said American locking cylinder functioning to actuate said conversion adapter, which subsequently rotates and drives a bolt supported within said Profile cylinder mortise lock, thus selectively locking and unlocking said door.

In one exemplary embodiment, the door cylinder conversion adapter comprises: (a) a Profile conversion hub configured to fit within an eyehole on an external facing side of an existing Profile cylinder mortise lock, wherein the hub comprises a rotatable cam having a slot for receiving a tailpiece of the American door lock cylinder; and (b) a Profile conversion plug also fittable within the eyehole, but on an internal facing side of the Profile mortise lock, wherein the plug adjustably locks with the hub and also seals the eyehole. In addition, the Profile conversion plug receives one or more stoppers on the Profile conversion hub that prevent the American locking cylinder from freely rotating. Just as a Profile door lock cylinder would, the American locking cylinder actuates a bolt to secure the door. However, actuation of the American locking cylinder functions to drive the adapter hub, and particularly the cam that is built right into the adapter, which subsequently drives the bolt to secure or lock the door. To unlock the door, the American locking cylinder is again actuated by rotating it in the opposite direction.

The present invention further features a method for converting and operating a door lock assembly, and particularly to a method for operably connecting an American locking cylinder with a Profile cylinder mortise lock.

BRIEF DESCRIPTION OF THE DRAWINGS

The present invention will become more fully apparent from the following description and appended claims, taken in conjunction with the accompanying drawings. Understanding that these drawings merely depict exemplary embodiments of the present invention they are, therefore, not to be considered limiting of its scope. It will be readily appreciated that the components of the present invention, as generally described and illustrated in the figures herein, could be arranged and designed in a wide variety of different configurations. Nonetheless, the invention will be described and explained with additional specificity and detail through the use of the accompanying drawings in which:

FIG. 3-A illustrates an exploded isometric view of a door locking system featuring an American cylinder lock operably connected to a Profile mortise lock using a door lock cylinder conversion adapter according to one exemplary embodiment of the present invention;

FIG. 3-B illustrates an exploded side view of the door locking system illustrated in FIG. 3-A.

DETAILED DESCRIPTION OF EXEMPLARY EMBODIMENTS

Figure 1:
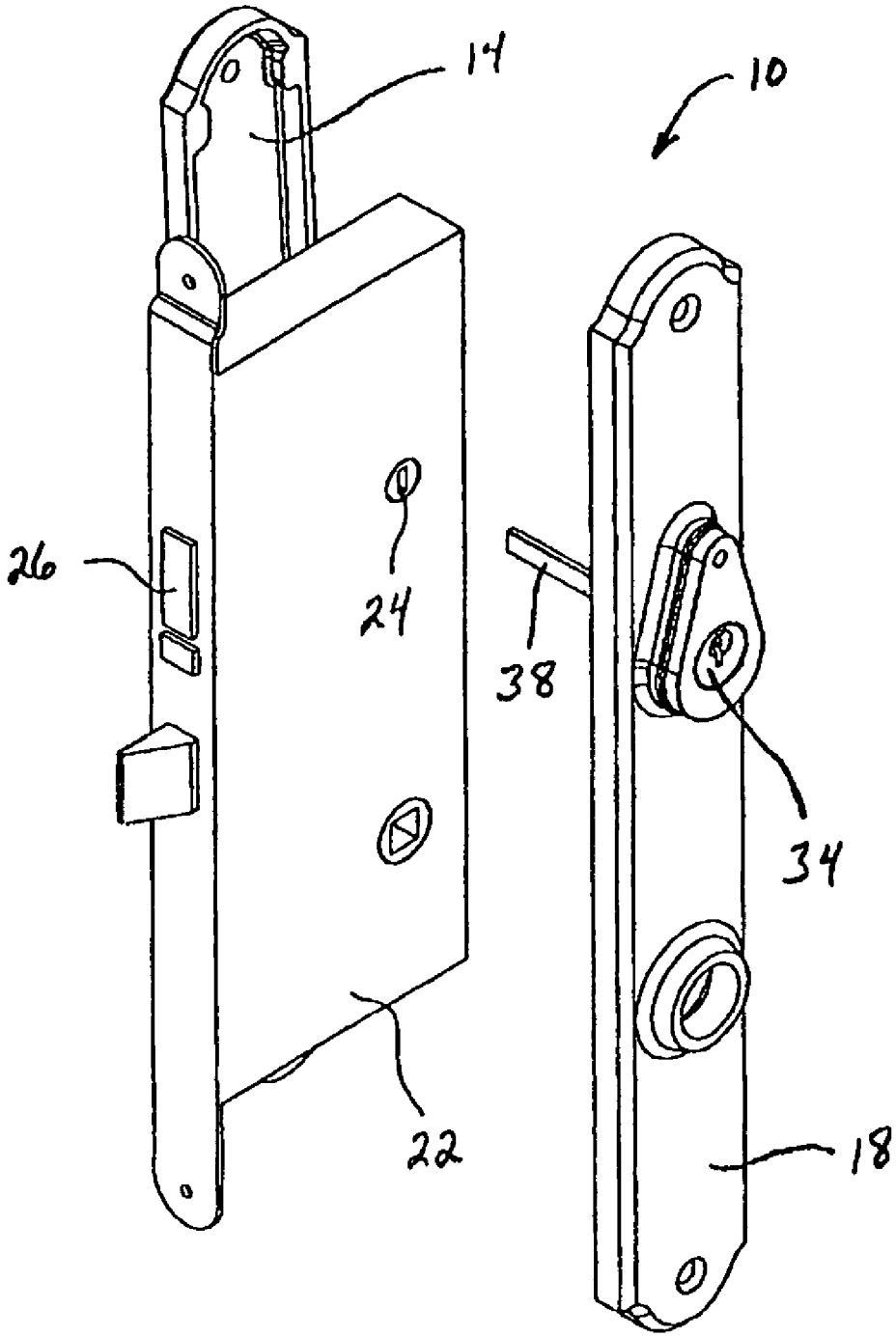
FIGURE 1 (Prior Art)
FIG. 1 illustrates an exploded isometric view of a prior art American-type or American style door locking system or assembly featuring an American mortise lock and an American cylinder lock.
Figure 2:
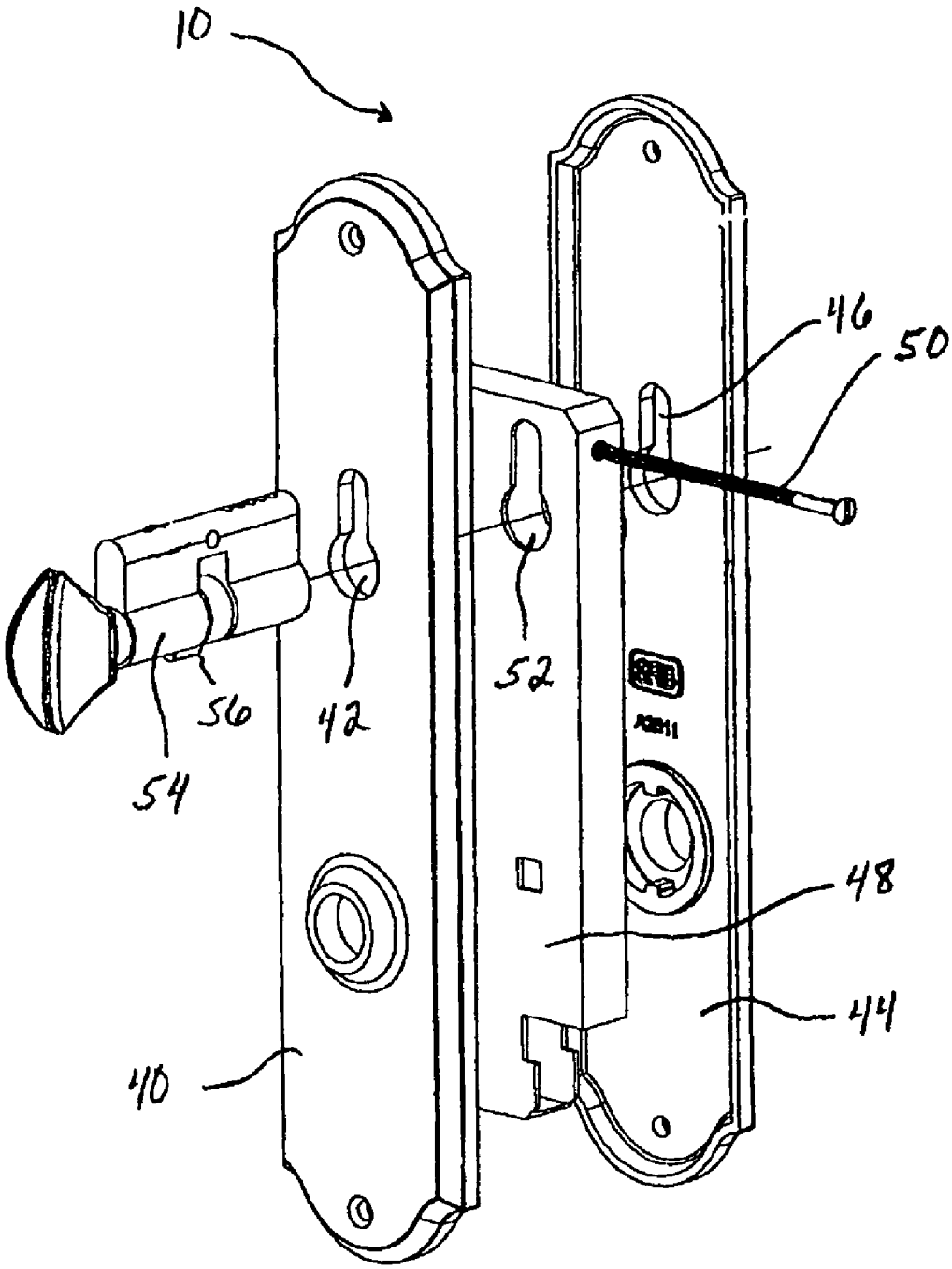
FIGURE 2 (Prior Art)
FIG. 2 illustrates an exploded isometric view of a prior art Profile-type or Profile style door locking system or assembly featuring a Profile mortise lock and a Profile cylinder lock.

The following detailed description of exemplary embodiments of the invention makes reference to the accompanying drawings, which form a part hereof and in which are shown, by way of illustration, exemplary embodiments in which the invention may be practiced. While these exemplary embodiments are described in sufficient detail to enable those skilled in the art practice the invention, it should be understood that other embodiments may be realized and that various changes to the invention may be made without departing from the spirit and scope of the present invention. Thus, the following more detailed description of the embodiments of the present invention, as represented in FIGS. 1 through 6, is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

The following detailed description and exemplary embodiments of the invention will be best understood by reference to the accompanying drawings, wherein the elements and features of the invention are designated by numerals throughout.

The present invention describes a method and system for operating or operably connecting an American locking cylinder with a Profile cylinder mortise lock, wherein the American locking cylinder functions with the Profile cylinder mortise lock in place of a Profile locking cylinder.

With reference to FIGS. 3-A and 3-B, the present invention features a door lock system or door lock assembly 96 (hereinafter referred to door lock assembly 96) featuring 30 certain components from an American door lock assembly operably connecting with certain components from a Profile door lock assembly. This hybrid door lock assembly 96 specifically comprises, as some of its components, an American or American-type plate mount assembly consisting of internal plate mount 14 and external plate mount 18. Internal plate mount 14 couples to the inside of a door (not shown) and provides a support for turn piece 40 that allows a user to manually actuate door lock assembly 96. External plate 18 couples to the outside of a door and further comprises a cylinder casing 20 that functions to house and support an American locking cylinder 34. American or American-type internal and external plate mounts 14 and 18 as shown in FIGS. 3-A and 3-B are exemplary of only one type of design. Indeed, internal plate mount 14 and external plate mount 18 may comprise different designs, each having the ability to support and function with an American locking cylinder.

FIG. 3-A shows American locking cylinder 34 as comprising a keyhole 36 configured to receive one or more keys therein for actuating door lock assembly 96. American locking cylinder 34 further comprises a tailpiece 38 outwardly extending from a main housing (not shown), wherein tailpiece 38 is inserted such that an end portion of tailpiece 38 comes to rest or is seated within turn piece 40 rotatably supported by internal plate mount 14.

One significant advantage of American locking cylinder 34 is the ability for tailpiece 38 to be cut to different lengths, thus allowing door lock assembly 96 to accommodate a variety of doors of varying thickness without requiring the replacement of the entire door lock assembly. On the other hand, as explained above, a Profile type door lock assembly replaces the entire mortise case in order to accommodate a replacement door having a different thickness than that of the original, thus significantly increasing the cost of replacing the door.

American locking cylinders are commonly known in the art. However, the present invention contemplates using other similar locking cylinders of the American-type that are configured for use with American-type internal and external plate mounts, and that comprise a similar structure to American locking cylinder 34 as shown in FIGS. 3-A and 3-B, including tailpiece 38.

FIGS. 3-A and 3-B further illustrate door lock assembly 96 comprising a Profile cylinder or Profile cylinder-type mortise lock 48 (hereinafter referred to as Profile mortise lock 48). A Profile mortise lock 48 comprises a mortise case 50 having a slotted eyehole 52 formed therein. The Slotted eyehole 52 is of the size and shape configured to receive a standard Profile locking cylinder as commonly known in the art and described above. The Profile mortise lock 48 further comprises an internal locking mechanism (not shown) that consists of a movable bolt that may be selectively actuated to be inserted into and retracted from a door jam, thus locking and unlocking a door, respectively. The bolt contained within Profile mortise lock 48 is typically actuated by a Profile locking cylinder, such as the one shown in FIG. 1 and described above, wherein the Profile locking cylinder comprises a cam rotatably mounted on cylinder that functions to actuate the bolt or bolt mechanism contained within the mortise lock.

As can be seen, Profile mortise lock 48 comprises one of the essential components of door lock assembly 96. However, unlike prior related door lock assemblies that utilize a Profile locking cylinder contained within Profile or Profile-type internal and external plate mounts, Profile mortise lock 48 is used or made to operate with American locking cylinder 34 and American internal and external plate mounts 14 and 18, respectively, as a result of the present invention. Because there are significant structural and design differences between an American mortise lock and a Profile mortise lock, it has heretofore been impossible to use an American locking cylinder with a Profile mortise lock, even though American door locking assemblies provide many advantages over Profile door locking assemblies.

As can be seen in FIG. 3-A and 3-B, door lock assembly 96 features an American locking cylinder 34 that spans between and is supported by American internal and external plate mounts 14 and 18 as previously known to those skilled in the art. However, instead of utilizing an American mortise lock, door lock assembly 96 comprises a Profile mortise lock 48, wherein American cylinder 34 functions to operate with or actuate Profile mortise lock 48, and particularly the bolt or bolt mechanism contained therein, thus locking and unlocking the door. What makes these two different component parts operate together is the presence of door conversion adapter 100 (hereinafter conversion adapter 100). Conversion adapter 100 effectively functions to convert American locking cylinder 34, and particularly tailpiece 38, to be used with and to actuate the locking components of Profile mortise lock 48.

In one exemplary embodiment, door conversion adapter 100 comprises a two piece design, namely a Profile conversion hub 104 and a Profile conversion plug 150. Profile conversion hub 104 plugs into the circular portion of slotted eye hole 52 from a forward facing or front side of Profile mortise lock 48. On the other hand, Profile conversion plug 150 plugs into the slotted portion of eye hole 52 from a back or opposing side of Profile mortise lock 48.

A Profile mortise lock is different from an American mortise lock in many ways, including the cylinders used and the configuration of the mortise case and internal locking components. An American mortise lock comprises a slotted member for receiving only the tailpiece of an American locking cylinder, wherein the slotted member is coupled to a cam that is internalized within the mortise case and that rotates or drives the associated internal locking components. On the other hand, a Profile mortise lock comprises a slotted eyehole configured to receive the cylinder portion of a Profile locking cylinder, wherein the cam is rotatably contained on the cylinder itself. An entire portion of the body of the cylinder comprising the cam is inserted into the mortise case through the slotted eyehole so that the cam is properly positioned to operate with the internal locking mechanism. Until now, interchanging components of the two and allowing a Profile mortise lock to be operable with an American cylinder has not generally been possible, or at least has been unworkable.

Once inserted into Profile mortise lock 48 and door lock assembly 96 is assembled, Profile conversion hub 104 and Profile conversion plug 150 fit together in an adjustably locking manner. Their adjustable relationship is explained in further detail below. In this coupled arrangement, door conversion adapter 100 converts American locking cylinder 34 so that it is similar in both form and function to a standard Profile locking cylinder. Advantageously, in order to be operable with Profile mortise lock 48, American locking cylinder 34 itself does not require alteration. Instead, the door lock assembly of the present invention utilizes conversion adapter 100 that functions both to receive and function with an American or American type locking cylinder as well as to drive a Profile or Profile-type mortise lock.

As shown, Profile conversion hub 104 comprises a built in cam 120 that is rotatable about a cylinder, wherein cam 120 functions to rotate, contact, and drive the bolt mechanism contained within Profile mortise lock 48, thus locking and unlocking a door. Profile conversion hub 104 is, in part, operably functional with American locking cylinder 34 due to the presence of tailpiece receiver or duct 132 extending down and oriented about a longitudinal axis through each of the components of conversion adapter 100. Duct 132 comprises a geometric configuration or shape similar to that of tailpiece 38, thus allowing tailpiece duct 132 to receive tailpiece 38 therein, as well as to provide the structural support needed when actuating tailpiece 38. Once inserted into conversion adapter 100, tailpiece 38 operates as normal to drive and rotate cam 120.

Upon assembling door lock assembly 96, tailpiece 38 is initially inserted through tailpiece duct 132 of conversion adapter 104. Tailpiece 38 further extends through Profile mortise lock 48, guide ring 172 of Profile conversion plug 150, and internal plate mount 14, with its end portion finally coming to rest or seating within turn piece 40. As such, once each of the component parts of door lock assembly 96 are coupled together, a key may be inserted into key hole 36. Turning or rotating the key or turning or rotating turn piece 40 effectively causes tailpiece 38 to rotate. In turn, rotating tailpiece 38 subsequently drives conversion adapter 100, and particularly cam 120 of Profile conversion hub 104. Depending on the direction of rotation, cam 120 effectively actuates the bolt mechanism contained within Profile mortise lock 48 to either lock or unlock the door.

FIG. 3-B further illustrates Profile mortise lock 48 as comprising a thickness t. This thickness corresponds directly to the size of door in which Profile mortise lock 48 will be used. A Profile locking assembly or a similar Profile-type locking assembly is not adjustable like an American locking assembly or similar American-type locking assembly. Therefore, for each door thickness, a corresponding Profile locking assembly must be manufactured, wherein the Profile locking assembly comprises a Profile locking cylinder having specific dimensions to operate a Profile mortise lock having a specific thickness t. Unfortunately, there are several brands of doors, with each brand having doors of varying thicknesses. To meet the demands of customers that may select a door from any one door manufacture, lock suppliers must have a large inventory of different sized Profile or Profile-type locking assemblies, if such a locking assembly is desired. Obviously, this creates added expense for the supplier. In addition, if a door is replaced with a new door having a different thickness than the original, an entire new Profile locking assembly must be purchased as the change in door thickness will cause the existing Profile locking assembly to be inoperable. As such, a door replacement ends up costing the consumer much more, especially if there are several doors that are being replaced, which is often the case when remodeling. Moreover, the Profile locking cylinder itself is expensive. Thus, if it malfunctions, it will be expensive to replace. Profile mortise lock 48, having thickness t, represents only one size of mortise lock, which must be used with a specifically sized Profile locking cylinder.

Unlike their Profile or Profile-type door locking assembly counterparts, American or American-type door locking assemblies are adjustable to accommodate different door thicknesses. Thus, a single American door locking assembly will fit doors of varying thickness, giving them a significant advantage over Profile locking assemblies. As designed, an American door locking assembly comprises a standard sized mortise case that fits within a large number of doors of varying thicknesses, as well as an adjustable American locking cylinder. To adjust an American locking assembly to appropriately fit a door of a given thickness, one simply trims the tailpiece of the American locking cylinder to the right size. If a door replacement is desired, then either the tailpiece is trimmed further (if the replacement door is thinner) or a new inexpensive tailpiece is purchased to replace the original one (if the new door is thicker than the original). There is no need to replace the entire locking assembly or any of its major components as with a Profile locking assembly.

The present invention advances the art by providing a way to convert an American locking cylinder so that it may be used with a Profile mortise lock. Essentially, what the present invention accomplishes is the elimination of the Profile locking cylinder, or rather the requirement to use a Profile locking cylinder with a Profile mortise lock. In place of the Profile locking cylinder, an American locking cylinder may be combined with the present invention conversion adapter to operate or actuate the Profile mortise lock and its components in a similar manner or just as a Profile locking cylinder would. Moreover, because American locking cylinders are adjustable, and because the present invention conversion adapter is also adjustable to fit within different sized Profile mortise locks, the advantage of combining these components is that existing Profile locking assemblies, namely existing Profile mortise locks, may be kept and used on doors of different thicknesses without having to replace the entire locking assembly, particularly the Profile mortise lock and Profile locking cylinder. As such, the many benefits and advantages of an American locking system, and particularly an American locking cylinder, are passed onto a Profile locking assembly.

Figure 4:
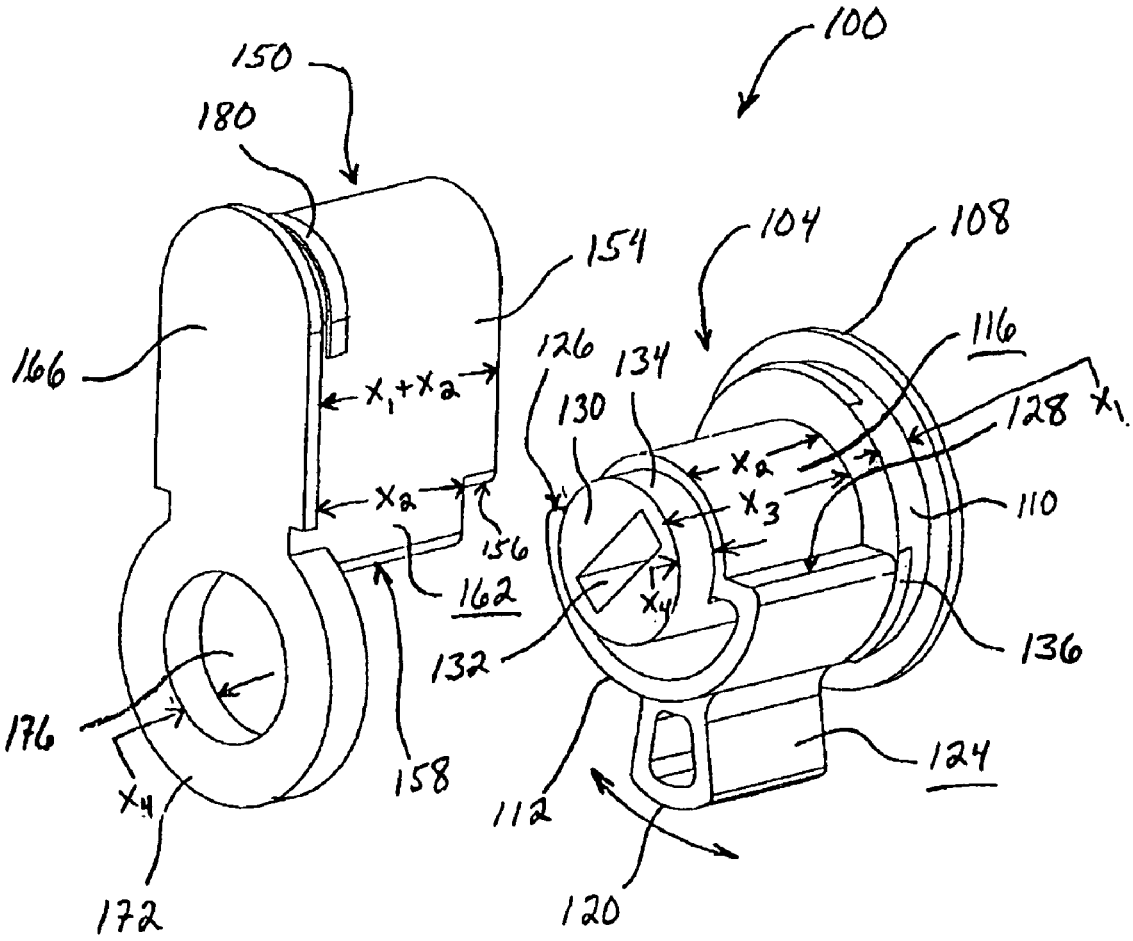
FIG. 4 illustrates an exploded isometric view of the component parts of an exemplary door lock cylinder conversion adapter, namely an exemplary Profile conversion hub and an exemplary Profile conversion plug.
Figure 5:
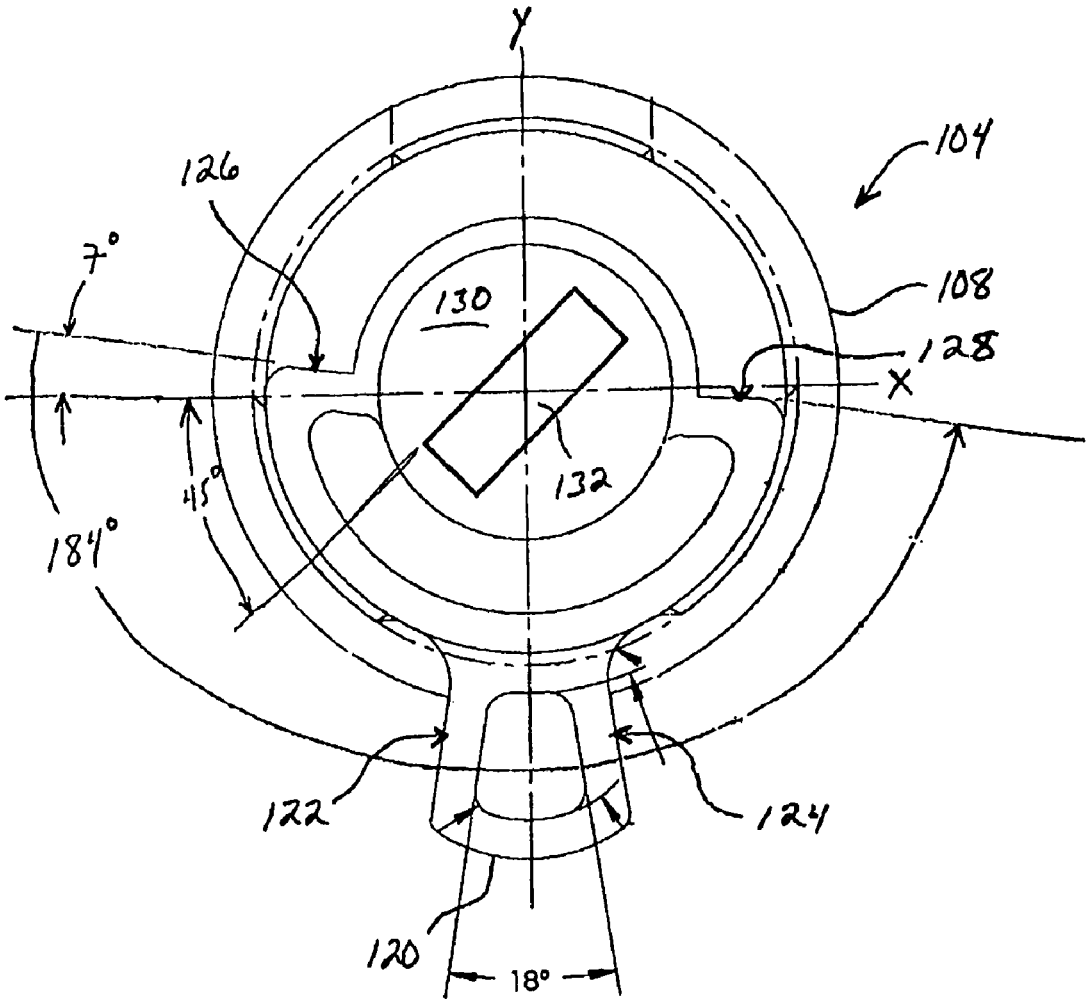
FIG. 5 illustrates a rear view of the exemplary Profile conversion hub illustrated in FIG. 4.
Figure 6:
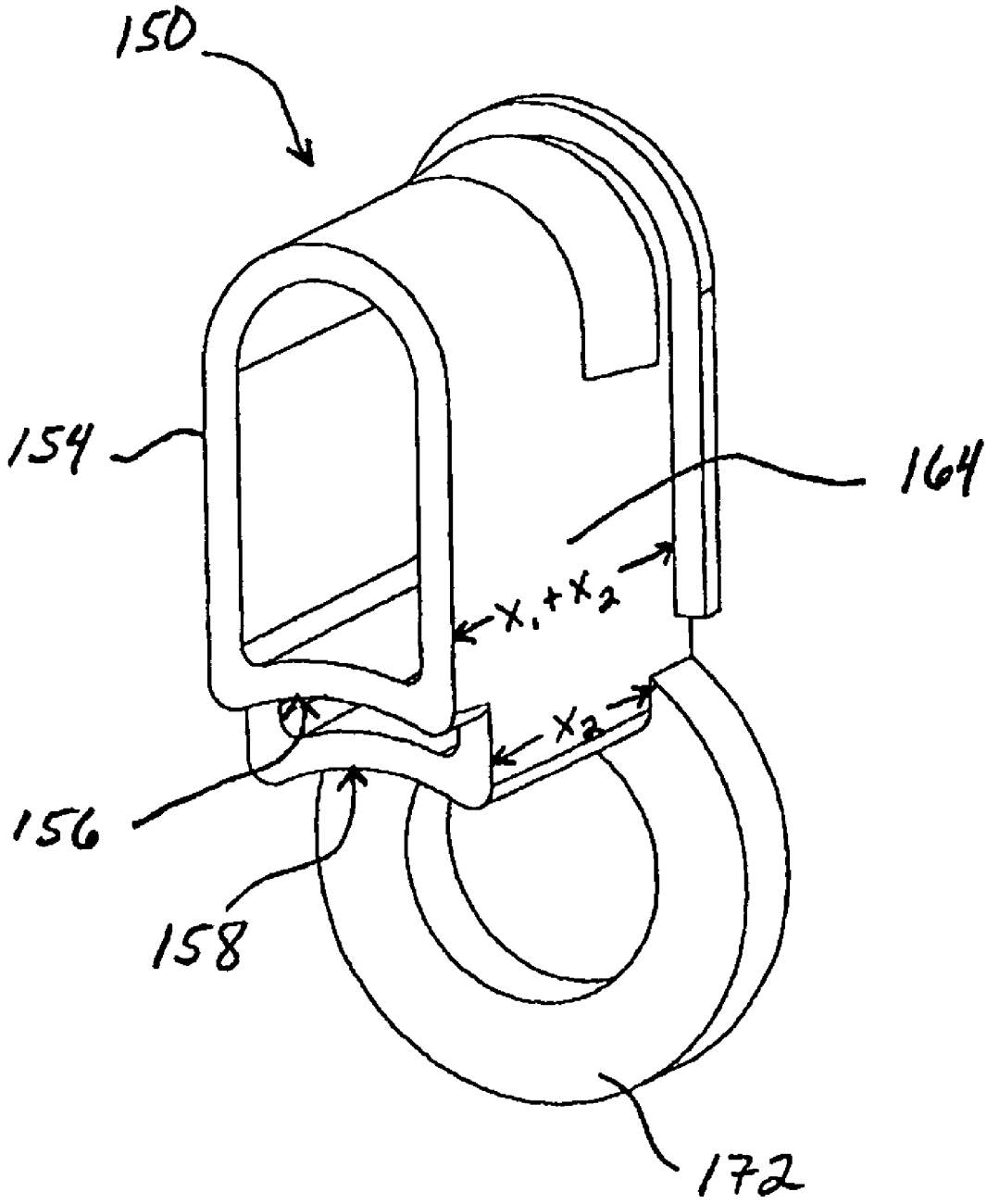
FIG. 6 illustrates rear view of the exemplary Profile conversion plug illustrated in FIG. 4.

Referring now to FIGS. 4-6, various views of the components of door conversion adapter 100 are shown according to one exemplary embodiment. As shown, door cylinder conversion adapter 100 comprises two complementary components, namely Profile conversion hub 104 and Profile conversion plug 150. Profile conversion hub 104 comprises a flange portion 108 in the form of a circular disk that is positioned directly adjacent a seat 110. Seat 110 extends a distance $x_1$ from flange 108 and is configured to be inserted into the circular portion of a slotted eyehole formed within a Profile mortise lock to secure hub 104 in place. Thus, seat 110 comprises a diameter that is slightly less than the diameter of the eyehole's circular portion. On the other hand, flange 108 comprises a diameter that is larger than the diameter of the circular portion of the slotted eyehole (see eyehole 52 in FIG. 3-A), thus functioning as a stopper for achieving the proper insertion position of hub 104 within the eyehole.

When hub 104 is properly inserted, the inside surface of flange 108 rests against the surface of the Profile mortise lock immediately surrounding the circular portion of the eyehole. In addition, seat 110 fits snugly into the circular portion of the eyehole. To secure it in place once inserted, Profile conversion hub 104 further comprises a plurality of retainers 136 positioned about seat 110. Retainers 136 comprise a protruding wedge shape having a slanted portion and a vertical back. Starting from the edge of seat 110 distal flange 108, the slanted portion extends back towards flange 108 and rises to a given pre-determined height. At this height, the vertical edge or back is formed, thus creating the wedge. Retainers 136 are positioned on seat 110 so as to leave a gap between the vertical back portion of each retainer and the surface of flange 108. This gap comprises a width slightly less than the wall thickness of the Profile mortise case so that when hub 104, and particularly seat 110, is inserted into the eyehole of the Profile mortise lock, the edges of the eyehole slide up the angled surface of retainers 136 and then drop into the gap between the vertical back and the surface of flange 108. Once the edges of the eyehole drop within this gap, Profile conversion hub 104 is secured into place. Within flange 108 is formed a slot or duct 132 configured to receive a tailpiece of an American locking cylinder.

Duct 132 extends through flange 108 and through the entire Profile conversion hub 104, thus allowing a tailpiece of an American locking cylinder to be inserted completely through door conversion adapter 100 within a Profile mortise lock and finally seated in a turn piece.

Profile conversion hub 104 further comprises a cylinder 130 extending from flange 108. Duct 132, beginning at flange 108, extends through cylinder 130, thus allowing a tailpiece of an American locking cylinder to be inserted completely through door conversion adapter 100 within a Profile mortise lock and finally seated in a turn piece.

Surrounding or partially surrounding cylinder 130, or rather disposed or partially disposed concentrically about cylinder 130, or at least a portion of cylinder 130, is a cam support 112. Cam support 112 outwardly extends from seat 110 in the direction shown and a distance $x_2$, which distance is less than that of cylinder 130. In one exemplary aspect, taking a cross-section viewed from the front, cam support 112 comprises an upper half-circle having a smaller inside radius than that of a lower half-circle. The inside radius of the upper half-circle is such that it mates with or rests along an outer surface 134 of cylinder 130. The lower half-circle comprises a substantially larger inside radius, with the larger lower half-circle connecting with the smaller upper half-circle via ledges 126 and 128 positioned on opposing sides of one another. Ledges 126 and 128 function as stoppers that are further explained below. In another aspect, cam support 112 may comprise a uniform cross sectional shape in the form of a complete circle that concentrically surrounds cylinder 130. In this embodiment, cam 120 itself would function as a stopper to prevent it from being able to freely rotate.

Profile conversion hub further comprises a cam 120 extending from cam support 112. Cam 120 functions to contact and actuate the bolt mechanism contained within the Profile mortise lock that subsequently drives the bolt into a locked or unlocked position relative to the door jamb. Cam 120 is securely coupled to cylinder 130 so that any rotation of cylinder 130 by the inserted tailpiece is transferred to cam support 112 and ultimately cam 120. Stated differently, when the present invention door locking assembly is fully assembled, inserting a key into the key hole and rotating the key (or rotating the turn piece) effectively rotates the tailpiece of the locking cylinder, which subsequently drives door locking conversion adapter 100, and particularly cylinder 130, cam support 112, and cam 120. As cam 120 is caused to rotate, either one of sides 122 or 124 contact the bolt or bolt mechanism within the Profile mortise lock, thus driving the bolt to either lock or unlock the door, depending upon the direction the key (or turn piece) is rotated.

In addition, unlike a Profile locking cylinder whose cam freely rotates within or about the cylinder, the rotation of cam 120 is limited by presence of ledges 126 and 128 formed into cam support 112. When rotating cylinder 120 and cam support 112 in a clockwise direction (viewing Profile conversion hub 104 from the front), cam 120 rotates until ledge 128 comes in contact with first sidewall 162 of Profile conversion plug 150, thus stopping the rotation within adapter 100 and the locking cylinder (as well as the key and the turn piece) in that direction. Conversely, if cylinder 120 and cam support 112 are caused to rotate in a counterclockwise direction, cam 120 rotates until ledge 126 comes in contact with an opposing second sidewall 164 (shown in FIG. 6), thus stopping the rotation of the adapter and the locking cylinder in that direction. Ledges 126 and 128 are not necessarily required in door conversion adapter 100. Indeed, various alternative exemplary embodiments may comprise cam 120 itself functioning as the means for preventing rotation by contacting first and second sidewalls 162 and 164.

Cam support 112 comprises a pre-determined length $x_2$ extending from seat 110. Cylinder 130 also comprises a pre-determined length $x_3$ extending from seat 110. As can be seen, the length $x_3$ of cylinder 130 is longer than the length $x_2$ of cam support 112, such that cylinder 130 protrudes from cam support 112 a length $x_4$. This length, $x_4$, is at least as thick as the guide ring 172 of Profile conversion plug 150 so that when Profile conversion hub 104 is coupled to Profile conversion plug 150 within a Profile mortise lock, cylinder 130 rests within aperture 176 of guide ring 172. Stated differently, guide ring 172 is only able to fit over cylinder 130 until it abuts cam support 112. In this position, door conversion adapter 100 is in its thinnest state and capable of being fit within the thinnest of Profile mortise locks.

FIG. 5 illustrates some specific dimensions of one exemplary embodiment of Profile conversion hub 104. As shown, Profile conversion hub 104 comprises a duct 132 oriented in an offset manner with respect to the x-axis. Duct 132 can be offset a pre-determined angle to optimize the rotation of the cam with respect to the internal locking mechanism of the Profile mortise lock. In this case, duct 132 is offset at a 45° angle with respect to x-axis. Duct 132 is also at a 45° angle with respect to cam 120 that is oriented 90° from the x-axis. Cam 120 comprises first and second sides 122 and 124 that are oriented 9° from the y-axis. Furthermore, cam support 112 comprises a first ledge 126 oriented upwards from the x-axis 7°, while opposing ledge 128 is oriented downward from the x-axis 3° such that the angle from ledge to ledge is 184°.

The complementary component of door conversion adapter 100 to Profile conversion hub 104 is Profile conversion plug 150. Profile conversion plug 150 comprises a flange back 166 that functions similar to flange 108 to limit the insert distance of Profile conversion plug 150. Outwardly extending from flange back 166 is insert 154 that has a similar geometric configuration as the slotted portion of the Profile mortise lock eyehole so as to be insertable within the eyehole from a side opposite that of Profile conversion hub 104. Insert 154 comprises a length $x_1+x_2$ such that when fully seated with Profile conversion hub 104, door cylinder conversion adapter 100 comprises two uniform edges. As stated above, insert 154 further comprises first and second sidewalls 162 and 164 that function to intercept ledges 126 and 128 of cam support 112 (or cam 120 itself) during actuation of adapter 100, thus limiting the available rotation of cam 120. Insert 154 further comprises one or more plug retainers 180 positioned about insert 154 that function in a similar manner as hub retainers 136 described above.

Extending downward from insert 154 is guide ring 172. Guide ring comprises an aperture 176 configured to snugly receive cylinder 130, as well as the tailpiece from an American locking cylinder.

FIG. 6 illustrates insert 154 as comprising a two-tiered bottom comprising an upper tier 156 and a lower tier 158, each comprising curved segments. Upper tier 156 comprises a curved segment having a radius that matches the radius of seat 110. Lower tier 158 comprises a curved segment having a radius that matches the radius of cam support 112. As such, when Profile conversion plug 150 is coupled to and fully seated with Profile conversion hub 104, lower tier 156 slides onto and over the surface of cam support 112 so as to mate with cam support 112 while upper tier 156 slides onto and over the surface of seat 110 so as to mate with seat 110. When coupled together, Profile conversion hub 104 and Profile conversion plug 150 function to provide one exemplary embodiment of a conversion adapter for operating an American locking cylinder with a Profile mortise lock as shown in FIGS. 3-A and 3-B.

Another unique feature of the present invention is the adjustability of door locking cylinder conversion adapter 100, thus allowing it to be incorporated for use within different sized Profile mortise locks, or Profile mortise locks having different thicknesses. The adjustability of door locking cylinder conversion adapter 100 is made possible by the respective lengths of each component, particularly length $x_2$ of cam support 112 and matching lower tier 158, and the slidable nature in which the two components fit together. Indeed, door cylinder conversion adapter may be assembled so that Profile conversion hub and Profile conversion plug 150 are not fully seated together, but that are instead semi-seated. In other words, the two complementary pieces can be spaced apart to accommodate thicker mortise cases. The available sizes are thus dependent, in part, upon the length $x_2$ of each component and the coupled relationship of lower tier 158 with cam support 112. The thickness t of the intended Profile mortise case will determine the relative seat positioning and coupled relationship of Profile conversion hub 104 with respect to Profile conversion plug 150. Adjusting Profile conversion hub 104 with respect to Profile conversion plug 150 to accommodate different door thicknesses effectively relocates or alters the relative position of cam 120 with respect to the internal locking mechanism of Profile mortise lock 48, thus allowing cam 120 to properly engage and actuate the internal locking mechanism of different sized Profile mortise locks as needed.

In another exemplary embodiment, door cylinder conversion adapter 100 comprises only a Profile conversion hub 104, without more. In this embodiment, cam 120 is allowed to freely rotate within a Profile mortise lock as there is no plug inserted within the eyehole to intercept it. As such, it should be noted herein that Profile conversion plug is not a required component for converting an American locking cylinder to be used with a Profile mortise lock.

In still another, but related, exemplary embodiment, Profile conversion plug may comprise simply a thin-profile device designed to plug into the slotted portion of the Profile mortise lock eyehole on an opposing side of the Profile conversion hub. In this embodiment, the thin-profile plug does not penetrate the Profile mortise lock enough to interfere with the rotation of cam 120 or even to couple the Profile conversion hub. The thin-profile Profile conversion plug would primarily function to seal a portion of the eyehole directly adjacent or covered by the plug.

The present invention further features a method for converting and operating a door lock assembly. In one exemplary embodiment the method comprises: (a) providing a Profile mortise lock installed within a door, wherein the Profile mortise lock comprises an internal locking mechanism accessible via an eyehole and configured to receive a Profile locking cylinder capable of actuating the internal locking mechanism; (b) obtaining an American locking cylinder having a tailpiece extending therefrom; (c) providing a door lock cylinder conversion adapter having a rotatable cam configured to actuate the locking mechanism; and (d) connecting the American locking cylinder with the Profile mortise lock such that the American locking cylinder selectively drives the rotatable cam and the locking mechanism, thus locking and unlocking a door.

In one aspect, the door lock cylinder conversion adapter comprises a Profile conversion hub, such as the one described above and illustrated in the Figures. In another aspect, the door lock cylinder conversion adapter comprises a Profile conversion plug slidably connected to the Profile conversion hub. In this embodiment, the Profile conversion hub can be adjusted with respect to the Profile conversion plug, which effectively adjusts the relative position of the cam with respect to the internal locking mechanism to accommodate doors of varying thickness.

In operation, the tailpiece of the American locking cylinder is inserted through a duct formed through the components of the door lock cylinder conversion adapter. This allows the American locking cylinder to drive the adapter, and subsequently the locking mechanism.

In light of the foregoing detailed description, there are several advantages realized by the present invention. First, what has previously been unworkable is now possible, namely operating an American locking cylinder with a Profile mortise lock, thus passing onto Profile or Profile-type door lock assemblies all of the inherent benefits and advantages of American or American-type door lock assemblies. Second, because of the adjustability of American locking cylinders, and the incorporation of the conversion adapter, existing Profile mortise locks do not have to be replaced when replacing the door with a thinner or thicker door. As door lock assemblies are expensive, particularly Profile door lock assemblies, the present invention allows users to significantly cut down on replacement costs. In addition, repair costs are reduced. Profile locking cylinders are expensive compared to their American counterparts. Thus, if a Profile locking cylinder breaks, an American locking cylinder may be used in its place. Third, existing Profile mortise locks can accommodate and be made to operate with varying door thicknesses. In the past, a different Profile mortise lock and associated locking cylinder was required to be purchased for use within a door having a different thickness than the original, now the same Profile mortise case can be used in the new door without tearing the case apart and changing out the internal locking components so that they are operable with the new American locking cylinder. Fourth, using an American locking cylinder with the conversion adapter eliminates the free-spin or free-rotation characteristic of Profile locking cylinders. Fifth, American locking cylinders mount from behind the external plate mount rather than from the front like Profile locking cylinders. As such, added protection from the environment is achieved, although still using a Profile mortise lock.

While several advantages are specifically recited herein, these are not meant to be limiting in any way. Indeed, one skilled in the art will recognize other benefits and advantages upon reading the disclosure herein and practicing the invention.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

More specifically, while illustrative exemplary embodiments of the invention have been described herein, the present invention is not limited to these embodiments, but includes any and all embodiments having modifications, omissions, combinations (e.g., of aspects across various embodiments), adaptations and/or alterations as would be appreciated by those in the art based on the foregoing detailed description. The limitations in the claims are to be interpreted broadly based the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. Accordingly, the scope of the invention should be determined solely by the appended claims and their legal equivalents, rather than by the descriptions and examples given above.

What is claimed and desired to be secured by Letters Patent is:

1. A door locking system comprising:

a mortise lock supported within a door between internal and external plate mounts, said mortise lock comprising an internal locking mechanism accessible via an eyehole configured to receive a locking cylinder;

a rotatable turn piece mounted on said internal plate mount;

a locking cylinder supported by and directly contacting said external plate mount, said locking cylinder having a flat, elongated tailpiece mounted to said locking cylinder and extending therefrom, said tailpiece having a distal end;

a door lock cylinder conversion adapter including a first portion received within said eyehole of said mortise lock for covering a circular portion of said eyehole and a second portion received within said eyehole of said mortise lock for covering a slotted portion of said eyehole, said elongated tailpiece extending from said locking cylinder supported by said external plate mount, through said conversion adapter, to said rotatable turn piece mounted on said internal plate mount, with said distal end of said tail piece seating in said rotatable turnpiece, said conversion adapter operable with said internal locking mechanism, said locking cylinder functioning to drive said door lock cylinder conversion adapter, thus actuating said locking mechanism to lock and unlock said door.

2. The door locking system of claim 1, wherein said first portion of said door lock cylinder conversion adapter comprises a conversion hub comprising:

a flange covering a circular portion of said eyehole;

a seat extending from said flange and comprising a diameter configured for insertion into said circular portion of said eyehole;

a cylinder extending from said flange;

a cam support concentrically disposed about a portion of said cylinder, said cam support having opposing ledges formed therein that are configured to contact opposing surfaces of a conversion plug, thus limiting rotation of said cam support within a pre-determined range;

a cam extending from said cam support and configured to selectively drive one or more internal locking components within said mortise lock upon rotation; and a duct formed through said conversion hub for receiving said tailpiece there through.

3. The door locking system of claim 2, wherein said cam support comprises opposing ledges formed therein that are configured to contact opposing surfaces of a conversion plug, thus limiting rotation of said cam support within a pre-determined range.

4. The door locking system of claim 2, wherein said cam functions to limit the range of rotation within said conversion hub.

5. The door locking system of claim 2, wherein said duct comprises a geometric configuration similar to that of said tailpiece.

6. The door locking system of claim 2, wherein said cam comprises different thicknesses to accommodate different sized mortise locks.

7. The door locking system of claim 2, wherein said cam comprises a minimum thickness operable with any sized mortise lock.

8. The door locking system of claim 2, wherein said second portion of said door lock cylinder conversion adapter comprises a conversion plug slidably connecting with said conversion hub, said conversion plug comprising:

a flange back limiting the insert distance of said conversion plug and covering a slotted portion of said eyehole;

an insert extending from said flange back and configured for insertion into said slotted portion, said insert having a first and second surface for receiving said ledges, respectively, thus limiting rotation of said cam in a given direction;

a guide ring extending downward from said insert and comprising an aperture configured to receive a portion of said cylinder of said conversion hub through said eyehole of said mortise lock; and a tiered bottom surface, wherein a lower tier slidably relates with said cam support and wherein an upper tier slidably relates with said seat when said conversion plug connects with said conversion hub.

9. The door locking system of claim 2, wherein said duct is oriented in an offset manner a pre-determined angle as measured from a horizontal x-axis.

10. The door locking system of claim 1, wherein said mortise lock comprises one of several sizes, depending upon the thickness of said door.

11. A door locking system comprising:

a mortise lock supported within a door between internal and external plate mounts, said mortise lock comprising an internal locking mechanism accessible via an eyehole configured to receive a locking cylinder;

a locking cylinder supported by and directly contacting said external plate mount, said locking cylinder having an adjustable tailpiece mounted to and extending therefrom and seating within a rotatable turn piece mounted on said internal plate mount;

a door lock cylinder conversion adapter including a first portion for covering a circular portion of said eyehole and a second portion for covering a slotted portion of said eyehole, said conversion adapter operable with said internal locking mechanism, said locking cylinder functioning to drive said door lock cylinder conversion adapter, thus actuating said locking mechanism to lock and unlock said door;

wherein said first portion of said door lock cylinder conversion adapter comprises a conversion hub including a flange covering a circular portion of said eyehole;

a seat extending from said flange and comprising a diameter configured for insertion into said circular portion of said eyehole, said seat of said conversion hub including one or more retainers positioned about said seat and configured to securely retain said conversion hub in said circular portion of said eyehole of said mortise lock once inserted into said eyehole;

a cylinder extending from said flange;

a cam support concentrically disposed about a portion of said cylinder, said cam support having opposing ledges formed therein that are configured to contact opposing surfaces of a conversion plug, thus limiting rotation of said cam support within a pre-determined range;

a cam extending from said cam support and configured to selectively drive one or more internal locking components within said mortise lock upon rotation; and a duct formed through said conversion hub for receiving said tailpiece there through.

12. A door locking system comprising:

a mortise lock supported within a door between internal and external plate mounts, said mortise lock comprising an internal locking mechanism accessible via an eyehole configured to receive a locking cylinder;

a locking cylinder supported by and directly contacting said external plate mount, said locking cylinder having an adjustable tailpiece mounted to and extending therefrom and seating within a rotatable turn piece mounted on said internal plate mount;

a door lock cylinder conversion adapter including a first portion for covering a circular portion of said eyehole and a second portion for covering a slotted portion of said eyehole, said conversion adapter operable with said internal locking mechanism, said locking cylinder functioning to drive said door lock cylinder conversion adapter, thus actuating said locking mechanism to lock and unlock said door; wherein said first portion of said door lock cylinder conversion adapter includes a conversion hub having a flange covering a circular portion of said eyehole;

a seat extending from said flange and having a diameter configured for allowing insertion into said circular portion of said eyehole;

a cylinder extending from said flange;

a cam support concentrically disposed about a portion of said cylinder, said cam support having opposing ledges formed therein that are configured to contact opposing surfaces of a conversion plug, thus limiting rotation of said cam support within a pre-determined range;

a cam extending from said cam support and configured to selectively drive one or more internal locking components within said mortise lock upon rotation; and a duct formed through said conversion hub for receiving said tailpiece there through; and wherein said second portion of said door lock cylinder conversion adapter includes a conversion plug slidably connecting with said conversion hub, said conversion plug including a flange back limiting the insert distance of said conversion plug and covering a slotted portion of said eyehole;

an insert extending from said flange back and configured for insertion into said slotted portion, said insert having a first and second surface for receiving said ledges, respectively, thus limiting rotation of said cam in a given direction said insert of said conversion hub including one or more retainers positioned about said insert and configured to securely retain said conversion plug in said slotted portion of said eyehole of said mortise lock once inserted into said eyehole;

a guide ring extending downward from said insert and having an aperture configured to receive a portion of said cylinder of said conversion hub through said eyehole of said mortise lock; and a tiered bottom surface, wherein a lower tier slidably relates with said cam support and wherein an upper tier slidably relates with said seat when said conversion plug connects with said conversion hub.

13. A door locking system comprising:

a mortise lock supported within a door between an internal plate mount and an external plate mount, said mortise lock comprising an internal locking mechanism accessible via an eyehole configured to receive a cylinder;

a rotatable turn piece mounted on said internal plate mount;

a locking cylinder supported by and mounted to said external plate mount, said locking cylinder having a flat, elongated tailpiece extending therefrom, said tailpiece having a distal end;

a door lock cylinder conversion adapter for operably connecting said mortise lock with said locking cylinder, said door lock cylinder conversion adapter including a conversion hub configured to fit within a circular portion of said eyehole and to receive said tailpiece, said conversion hub including a duct having a cross section corresponding to that of the tailpiece, said elongated tailpiece extending from said locking cylinder mounted to said external plate mount, through said duct in said conversion hub, to said rotatable turn piece mounted on said internal plate mount, with said distal end of said tail piece seating in said rotatable turnpiece, said hub comprising a rotatable cam configured to engage and drive said locking mechanism; and a conversion plug configured to fit within a slotted portion of said eyehole, said plug receiving and adjustably locking with said conversion hub, said locking cylinder functioning to drive said adapter, which actuates said locking mechanism, thus selectively locking and unlocking said door.

14. The door locking system of claim 13, wherein said conversion hub and said conversion plug are slidably coupled in order to accommodate different door thicknesses having different sized corresponding mortise locks.

15. The door cylinder conversion adapter of claim 13, further comprising a conversion plug having a thin-profile design so as not to interfere with said conversion hub, but functioning to seal a portion of said eyehole configured to receive a locking cylinder on the side opposite said conversion hub.

16. A door cylinder conversion adapter configured to operably relate a locking cylinder to a mortise lock having an internal locking mechanism accessible via an eyehole configured to receive a locking cylinder, said eyehole having a circular portion and a slotted portion, said door cylinder conversion adapter comprising:

a conversion hub mounted within said circular portion of said eyehole and including a rotatable cam operatively coupled to a locking mechanism of a mortise lock, said rotatable cam having a duct for receiving a flat, elongated tailpiece of the locking cylinder, said locking cylinder selectively driving said rotatable cam and said locking mechanism, thus locking and unlocking a door, said conversion hub including one or more retainers configured to securely retain said conversion hub in said circular portion of said eyehole of said mortise lock once said conversion hub is inserted into said eyehole; and a conversion plug mounted within said slotted portion of said eyehole and connected to said conversion hub, said conversion plug including one or more retainers configured to securely retain said conversion plug in said slotted portion of said eyehole of said mortise lock once said conversion plug is inserted into said eyehole.

17. The door cylinder conversion adapter of claim 16, wherein said conversion hub and said conversion plug are axially adjustable relative to one another to accommodate different sized doors and their corresponding mortise locks.

18. A door locking system comprising:

a mortise lock supported within a door between internal and external plate mounts, said mortise lock comprising an internal locking mechanism accessible via an eyehole configured to receive a locking cylinder;

a locking cylinder supported by said external plate mount, said locking cylinder having a solid, substantially planar adjustable tailpiece extending therefrom and seating within a turn piece mounted on said internal plate mount;

a door lock cylinder conversion adapter operable with said internal locking mechanism, said locking cylinder functioning to drive said door lock cylinder conversion adapter, thus actuating said locking mechanism to lock and unlock said door;

said door lock cylinder conversion adapter comprising:

a conversion hub configured to fit within said eyehole and to receive said tailpiece, said hub comprising a rotatable cam configured to engage and drive said locking mechanism;

a conversion plug also configured to fit within said eyehole, said plug receiving and adjustably locking with said conversion hub, said locking cylinder functioning to drive said adapter, which actuates said locking mechanism, thus selectively locking and unlocking said door;

said conversion hub further comprising:

a flange extending radially with circumference greater than the circumference of said eyehole for covering a circular portion of said eyehole;

a seat extending from said flange and comprising a diameter configured for insertion into said circular portion of said eyehole;

said seat further comprising one or more wedge-shaped retainers positioned about said seat and configured to securely retain said conversion hub once inserted into said eyehole;

a cylinder extending from said flange;

a cam support concentrically disposed about a portion of said cylinder, said cam support having opposing ledges formed therein that are configured to contact opposing surfaces of a conversion plug, thus limiting rotation of said cam support within a pre-determined range;

said cam extending from said cam support and configured to selectively drive one or more internal locking components within said mortise lock upon rotation; and a duct formed through said conversion hub for receiving said tailpiece there through.

19. A door locking system comprising:

a mortise lock supported within a door between internal and external plate mounts, said mortise lock comprising an internal locking mechanism accessible via an eyehole configured to receive a locking cylinder;

a locking cylinder supported by said external plate mount, said locking cylinder having a solid, substantially planar adjustable tailpiece extending therefrom and seating within a turn piece mounted on said internal plate mount;

a door lock cylinder conversion adapter operable with said internal locking mechanism, said locking cylinder functioning to drive said door lock cylinder conversion adapter, thus actuating said locking mechanism to lock and unlock said door;

said door lock cylinder conversion adapter comprising:

a conversion hub configured to fit within said eyehole and to receive said tailpiece, said hub comprising a rotatable cam configured to engage and drive said locking mechanism;

a conversion plug also configured to fit within said eyehole, said plug receiving and adjustably locking with said conversion hub, said locking cylinder functioning to drive said adapter, which actuates said locking mechanism, thus selectively locking and unlocking said door;

said conversion hub further comprising:

a flange extending radially with circumference greater than the circumference of said eyehole for covering a circular portion of said eyehole;

a seat extending from said flange and comprising a diameter configured for insertion into said circular portion of said eyehole;

a cylinder extending from said flange;

a cam support concentrically disposed about a portion of said cylinder, said cam support having opposing ledges formed therein that are configured to contact opposing surfaces of a conversion plug, thus limiting rotation of said cam support within a pre-determined range;

said cam extending from said cam support and configured to selectively drive one or more internal locking components within said mortise lock upon rotation; and a duct formed through said conversion hub for receiving said tailpiece there through;

said door lock cylinder conversion adapter further comprising:

said conversion plug slidably connecting with said conversion hub, said conversion plug comprising:

a flange back limiting the insert distance of said conversion plug and covering a slotted portion of said eyehole;

an insert extending from said flange back and configured for insertion into said slotted portion, said insert having a first and second surface for receiving said ledges, respectively, thus limiting rotation of said cam in a given direction;

a guide ring extending downward from said insert and comprising an aperture configured to receive a portion of said cylinder of said conversion hub through said eyehole of said mortise lock;

a tiered bottom surface, wherein a lower tier slidably relates with said cam support and wherein an upper tier slidably relates with said seat when said conversion plug connects with said conversion hub; and said insert further comprising one or more wedge-shaped retainers positioned about said insert and configured to securely retain said conversion plug once inserted into said eyehole.

* * * * *